US005092204A

United States Patent [19]

Labriola

[11] Patent Number: 5,092,204

[45] Date of Patent: Mar. 3, 1992

[54] APPARATUS FOR ALIGNING SPHERICAL MEMBER DURING ASSEMBLY OF AN ARTICULATED COUPLING SYSTEM

[75] Inventor: Mike Labriola, Blue Island, Ill.

[73] Assignee: Westinghouse Air Brake Company, Wilmerding, Pa.

[21] Appl. No.: 588,173

[22] Filed: Sep. 26, 1990

[51] Int. Cl.[5] ..... B25B 13/50

[52] U.S. Cl. ..... 81/484; 81/488; 81/176.2

[58] Field of Search ..... 81/488, 484, 176.1, 81/176.15, 176.2; 254/131; 29/240, 271, 267

[56] References Cited

U.S. PATENT DOCUMENTS

| | | | |
|---|---|---|---|
| 4,258,628 | 3/1981 | Altherr | 105/4 R |
| 4,593,829 | 6/1986 | Altherr | 213/75 R |
| 4,867,071 | 9/1989 | Weber | 105/4.1 |
| 4,991,727 | 2/1991 | White | 81/488 |

OTHER PUBLICATIONS

Maintenance Manual for ASF Articulated Connection Assembly.

*Primary Examiner*—Roscoe V. Parker
*Attorney, Agent, or Firm*—Armstrong, Nikaido, Marmelstein, Kubovcik and Murray

[57] ABSTRACT

An apparatus for rotating a bearing assembly secured in an aperture at one end of a male connection member is provided. This apparatus includes an L-shaped member one leg of which engages a first surface formed on a longitudinal portion of a shaft member of such bearing assembly and a second leg which during use will be aligned with a bore formed in such outer end of the shaft member. A nut-like member is secured to an outer surface of such second leg which can be engaged by a tool capable of applying a force thereto for rotating such bearing assembly. Such nut-like member has a cavity formed therein adjacent an outer surface thereof. Such apparaus further includes a device for securing such apparatus to such bearing assembly in a removable manner.

21 Claims, 2 Drawing Sheets

APPARATUS FOR ALIGNING SPHERICAL MEMBER DURING ASSEMBLY OF AN ARTICULATED COUPLING SYSTEM

The present invention relates, in general, to articulated coupling systems which connect a first predetermined end of a first railway car to an adjacent predetermined end of a second railway car in a substantially semi-permanent manner and, more particularly, this invention relates to an apparatus for manipulating a spherical member carried by a male connection member into proper alignment with a female connection member during assembly of such articulated coupling systems.

BACKGROUND OF THE INVENTION

In the, modern railroad industry, it is quite well known, prior to the present invention, to use a standard railway car coupler to connect together adjacent ends of a pair of railway cars. These standard couplers have been approved for use in interchange service by the Association of American Railroads (AAR) for many years. In this application, for example, such standard couplers are designed and used to facilitate both the interconnecting together and the disconnecting of individual railway cars equipped with standard railway trucks at each end and the required cushioning device (draft gear) behind each coupler. However, these couplers do serve the purpose of allowing such cars to be readily combined to make-up a train consist, as well as to allow such cars to be individually separated, as necessary, for either loading or unloading purposes. Consequently, such standard couplers are the most commonly used couplers in such railroad industry.

Such railroad industry, however, in more recent times, has generally become aware of the desirability of interconnecting several such railway cars together to form a generally semi-permanent unit. A number of significant advantages can be attributed to such interconnecting of a number of cars together in this semi-permanent manner. This is particularly the case, for example, when a number of such railroad cars adapted for use in "piggyback" service have been joined together in this semi-permanent manner. Such railroad cars which are interconnected together in a substantially semi-permanent manner are generally recognized in the railroad industry as a "10-pack". These 10-pack units do not require the use of the standard coupler; nor is it desirable to use such standard coupler except between units. That is, the outermost end of the outer cars which make up such 10-pack unit. One of the primary reasons why these standard couplers are not required is because such 10-pack units, in practice, will only be periodically disconnected. Normally, such disconnection only occurs when maintenance of one or more of the individual components in the coupling arrangement employed must be carried out. It is, therefore, obvious that such semi-permanent coupling arrangement will enable the railroad industry to achieve a significant savings in cost. These cost savings will usually be derived from weight reduction, fewer railway trucks, reduced maintenance, and overall lower equipment costs, as well as a reduction in maintenance requirements. However, with the recent rather extensive use of these generally semi-permanent coupling arrangements, particularly with the new cars being constructed for use in piggyback service, and with the significantly increased loads which are carried by more modern railway cars and train consists, it has been determined that it is of critical importance for a close-buttoned relationship to be maintained between the draft components in the coupling system. Such close-buttoned relationships must be maintained, for example, so that the detrimental effects of the impact forces, which cannot normally be avoided and which are usually encountered under normal buff conditions during operation of a train consist, can be reduced to a generally acceptable level. When this close-buttoned relationship is maintained, then damage to both the equipment and the cargo being carried can be held to a minimum.

Reference is now made to U.S. Pat. No. 4,258,628, wherein one prior art type of articulated coupling apparatus that is used for the purpose of connecting together adjacent ends of a pair of railway cars in a semi-permanent manner is taught. As illustrated therein, this particular articulated coupling arrangement includes both a male connection member and a female connection member. The male connection member is secured to one end of a first railway car body and such female connection member is secured to an adjacent end of a second railway car body. It can be seen that the female connection member is rotatably-engaged in the center bowl portion centrally located in the bolster of a railway car truck in this prior art coupling arrangement. Such rotatable engagement is carried out in a manner that is quite well known in the railway art. The outer end portion of the male connection member is positioned for movement within a cavity that is disposed o the outer end portion of such female connection member.

A pin member is utilized in this arrangement to connect both the male connection member and the female connection member together in such a semi-permanent fashion. Such pin member is positioned in a vertical direction and is disposed within aligned apertures. An aperture being formed in each of such male connection member and such female connection member. However, as taught in this reference, the aperture formed in the male connection member, which receives the pin member therein, is required to be somewhat larger than the pin member itself. This larger aperture is required, so that certain necessary movements of the coupling arrangement can be achieved while in operation on a train consist. Further, a rear surface portion of the aperture formed in such male connection member has a horizontal concave configuration and a vertical convex configuration. In this coupling arrangement, these particular configurations enable both the male connection member and the female connection member to move in each of a horizontal direction and a vertical direction with respect to one another. At the same time, this configuration provides a relatively substantial area of surface contact between the rear surface of the pin aperture in the male connection member and the pin member itself. The outermost outer end surface of the outer end portion of such male connection member includes a convex configuration which abuttingly engages a complimentary concave surface, which is located on a front face portion of a follower member. Such follower member, in this coupler arrangement, is carried within the rear portion of such cavity disposed in the outer end portion of such female connection member. Such follower member, adjacent the rear surface portion thereof, includes a pair of vertically-disposed slot-like cavities formed therein. A first portion of a resilient member is disposed within each of these vertical slot-like cavities. Extending outwardly from such rear face portion of the follower member is a second portion of such resilient members. Therefore, in this manner, a portion of the exposed outer surface of each of the resilient members can be engaged by a vertically disposed wedge-like element. It is necessary, in this coupling arrangement, to provide such wedge-like element to urge both the follower member and the male connection member in a forward direction. When such follower member and such male connection member are urged forward then the rear surface portion of the aperture formed in the outer end of such male connection member is maintained substantially in contact with the pin member at all times.

Because the majority of the articulated connecting members that are used in this articulated coupling arrangement are manufactured as cast components, such contact between the pin member and the rear surface portion of such aperture formed in the male connection member is necessary. Furthermore, in order to achieve significant reduction in the cost of this coupling arrangement, these cast components will receive very little, if any, finish-machining, in order to provide either the necessary or desirable dimensional control. In other words, these cast connecting members will generally be used as cast. It is often times difficult, as a result of this cost-reduction practice, to provide an articulated coupling device which will be self-adjusting under the various wear conditions which will be encountered during in-track service of such coupling device. Nevertheless, it is of the utmost importance to minimize the slack encountered in the various coupling connections during such in-track service.

Other prior art articulated coupling devices are taught in U.S. Pat. No. 3,716,146 and in Canadian Patent No. 1,231,078.

SUMMARY OF THE INVENTION

The present invention provides an apparatus which is engageable with a bearing assembly positioned in and secured to an aperture formed through an outer end portion of a male connection member of an articulated coupling arrangement. Such apparatus enables rotating the bearing assembly to a position which allows a substantially semi-permanent connection of such male connection member within a cavity formed in an outer end portion of the female connection member of the articulated coupling arrangement to be more readily achieved. The apparatus includes a generally L-shaped member. An inner surface of a first leg of such L-shaped member is engageable with at least a portion of a substantially flat surface area formed along a longitudinal portion of a substantially round shaft member which is connected at one end thereof to an outer surface of a substantially spherical member of such bearing assembly. An inner surface of a second leg of the L-shaped member is engageable with at least a portion of an axially opposed outer end surface of such shaft member. There is an aperture formed through a portion of such second leg of the L-shaped member. This aperture is located in a position such that during use of the apparatus in rotating such bearing assembly, the aperture will be substantially in axial alignment with a substantially centrally located bore that is formed in such shaft member adjacent the outer end surface thereof. At least a portion of a back surface of a nut-like member is engageable with and secured to at least a portion of an outer surface of the second leg of the L-shaped member. The nut-like member has a predetermined configuration. The configuration used is such that it will enable a tool, which is capable of applying a force to such nut-like member that is at least sufficient to rotate such bearing assembly, to be engaged therewith. Such nut-like member has a cavity formed therein. The cavity is located adjacent an outer end surface of the nut-like member and substantially in axial alignment with such aperture formed through the second leg of the L-shaped member. The back surface of such nut-like member being axially opposed to the outer end surface thereof. Additionally, the apparatus includes a securing means that is positioned through the aperture formed through the second leg of such L-shaped member. At least a portion of such securing means is disposed within both the bore formed in the shaft member of the bearing assembly and the cavity formed in such nut-like member. This securing means enables the apparatus to be removably secured to the shaft member so that the bearing assembly can be rotated as necessary. This rotation can facilitate the connection of such male connection member to such female connection member of the articulated coupling arrangement.

OBJECTS OF THE INVENTION

It is, therefore, one of the primary objects of the present invention to provide an apparatus for rotating a bearing assembly disposed in an aperture at an outer end of a male connection member of an articulated coupling arrangement which will facilitate assembly and disassembly of such articulated coupling arrangement as required.

Another object of the present invention is to provide an apparatus for rotating a bearing assembly disposed in an aperture at an outer end of a male connection member of an articulated coupling arrangement which is relatively simple to use.

Still another object of the present invention is to provide an apparatus for rotating a bearing assembly disposed in an aperture at an outer end of a male connection member of an articulated coupling arrangement which is relatively inexpensive.

Yet another object of the present invention is to provide an apparatus for rotating a bearing assembly disposed in an aperture at an outer end of a male connection member of an articulated coupling arrangement which requires little or no maintenance.

A further object of the present invention is to provide an apparatus for rotating a bearing assembly disposed in an aperture at an outer end of a male connection member of an articulated coupling arrangement which will be cost effective by reducing the time required to assemble and disassemble such articulated coupling arrangement.

An additional object of the present invention is to provide an apparatus for rotating a bearing assembly disposed in an aperture at an outer end of a male connection member of an articulated coupling arrangement which can be easily secured to and removed from such bearing assembly.

Another object of the present invention is to provide an apparatus for rotating a bearing assembly disposed in an aperture at an outer end of a male connection member of an articulated coupling arrangement which can be easily transported between work locations.

Still another object of the present invention is to provide an apparatus for rotating a bearing assembly disposed in an aperture at an outer end of a male connection member of an articulated coupling arrangement which can be formed as a single piece casting or as a machined part.

Yet still another object of the present invention is to provide an apparatus for rotating a bearing assembly disposed in an aperture at an outer end of a male connection member of an articulated coupling arrangement which does not require any special tools to either install or use.

A still further object of the present invention is to provide an apparatus for rotating a bearing assembly disposed in an aperture at an outer end of a male connection member of an articulated coupling arrangement which can be secured to such bearing assembly by means of a bolt.

In addition to the various objects and advantages of the present invention described above, various other objects and advantages of such apparatus for rotating a bearing assembly disposed in an aperture at an outer end of a male connection member of an articulated coupling arrangement will become more readily apparent to those persons who are skilled in the railroad coupling art from the following more detailed description of such invention, particularly, when such description is taken in conjunction with the attached drawings and with the appended claims.

BRIEF DESCRIPTION OF THE INVENTION

Figure 2:
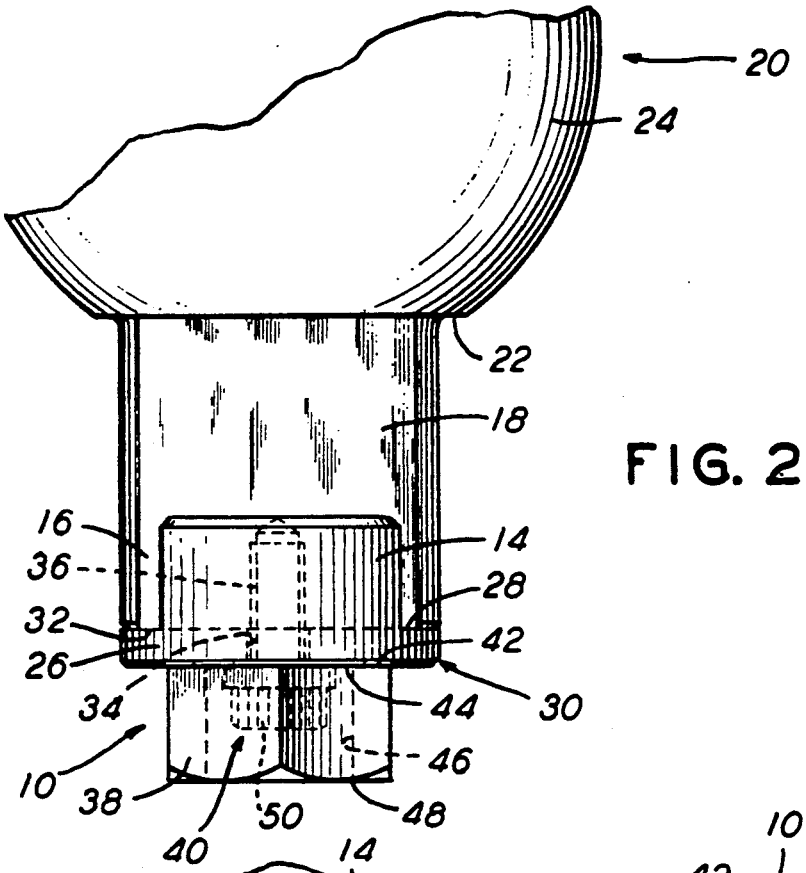
FIG. 2 is a fragmented top view of the presently preferred embodiment of the present invention illustrated in FIG. 1.

Prior to proceeding to the more detailed description of the present invention, it should be noted that in each of the several views which are illustrated in the attached drawings, identical components which have identical functions have been identified, for the sake of clarity, with identical reference numerals.

The apparatus of the present invention can be readily used in conjunction with the articulated type coupling arrangements which are disclosed in our co-pending and earlier filed U.S. patent applications having Ser. Nos. 07/520,686 and 07/520,687, which were accorded a filing date of May 8, 1990. The disclosure in such above-referenced co pending applications being incorporated herein by reference thereto.

Figure 1:
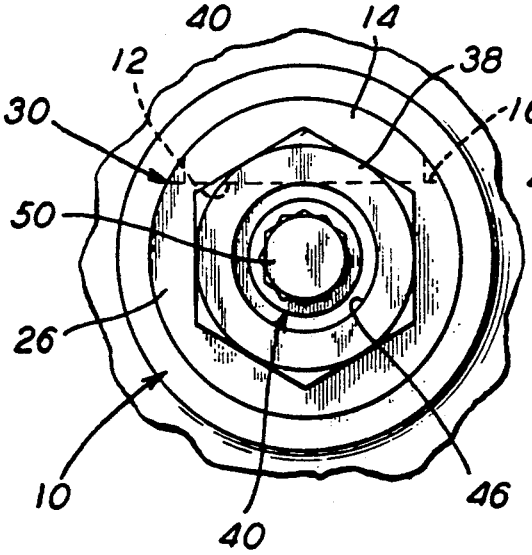
FIG. 1 is an end view which illustrates one presently preferred embodiment of an apparatus for rotating a bearing assembly in an articulated coupling arrangement.
Figure 3:
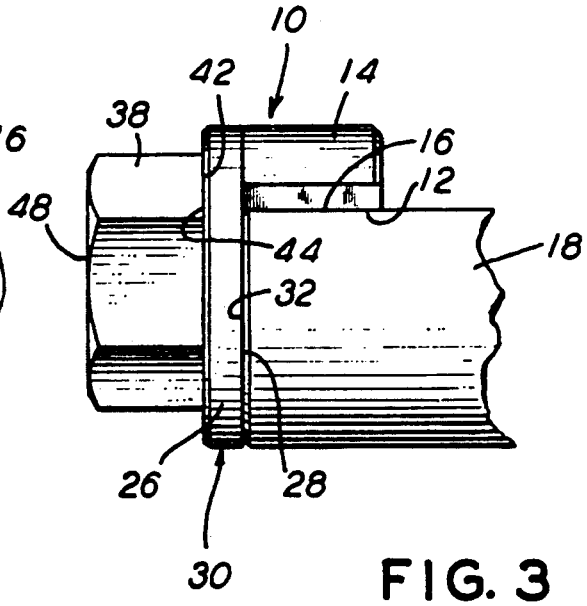
FIG. 3 is a fragmented side elevation view of the presently preferred embodiment of the present invention illustrated in FIGS. 1 and 2.

Particular reference is now made to FIGS. 1 through 3 in which an apparatus, generally designated 10, engageable with a bearing assembly, generally designated 20, positioned and secured to an aperture formed through an outer end portion of a male connection member (not shown) of an articulated coupling arrangement (not shown) is illustrated. Such apparatus 10 is useful in rotating such bearing assembly 20 to a position which enables a substantially semi-permanent connection of such male connection member within a cavity (not shown) formed in an outer end portion of a female connection member (not shown) of such articulated coupling arrangement to be achieved.

Such apparatus 10 includes a generally L-shaped member, generally designated 30, in which an inner surface 12 of a first leg 14 of such L-shaped member 30 is engageable with at least a portion of a substantially flat surface area 16. The flat surface area 16 is formed along a longitudinal portion of a substantially round shaft member 18. Such shaft member 18 is connected at one end thereof to an outer surface 22 of a substantially spherical member 24 of a bearing assembly 20. A second leg 26 of the L-shaped member 30 is engageable at an inner surface 28 thereof with at least a portion of an axially opposed outer end surface 32 of such shaft member 18.

An aperture 34 is formed through a portion of such second leg 26 of the L-shaped member 30. The purpose of such aperture 34 will become clear as the description of the invention proceeds. Such aperture 34 is located such that during use of the apparatus 10 to rotate the bearing assembly 20 it will be disposed substantially within axial alignment with a substantially centrally located bore 36 formed in such shaft member 18 adjacent the outer end surface 32 thereof.

A nut-like member 38 has at least a portion of a back surface 42 thereof that is engageable with and secured to at least a portion of an outer surface 44 of such second leg member 26 of the L-shaped member 30. Such nut-like member 38 is provided with a predetermined configuration, which in the presently preferred embodiment of the invention is hexagonal. Nevertheless, the configuration of such nut-like member 38 is such that it will enable a tool (not shown), capable of applying a force thereto that is at least sufficient to rotate the bearing assembly 20, to be engaged therewith.

A cavity 46 is formed in such nut-like member 38 adjacent a outer end surface 48 thereof. The purpose of such cavity 46 will become clear as the description of the invention proceeds. The cavity 46 is positioned in the nut-like member 38 such that it will be substantially in axial alignment with the aperture 34 formed through the second leg 26 of the L-shaped member 30. As is clear in FIGS. 1 and 3, the back surface 42 of the nut-like member 38 is axially opposed to the outer end surface 48 of such nut-like member 38.

The apparatus 10 further includes a securing means, generally designated 40, that is positioned through such aperture 34 formed through the second leg 26 of such L-shaped member 30. Securing means 40 is, also, disposed within both the bore 36 formed in such shaft member 18 and such cavity 46 formed in the nut-like member 38. Such securing means 40 is provided to enable removably securing the apparatus 10 to such shaft member 18, so that the bearing assembly 20 can be rotated as required to facilitate the connection of the male connection member to the female connection member of such articulated coupling arrangement. In one form of the present invention, the first leg 14 and the second leg 26 of such L-shaped member 30 can be formed as an integral single piece unit. This can be accomplished by either casting; such first leg 14 and such second leg 26 as a single piece casting or by machining such L-shaped member 30 from a block of metal. If such L-shaped member 30 is cast then it is possible to cast the aperture 34 in such second leg 26 at the same time.

Preferably, however, each of the L-shaped member 30, the aperture 3 formed in the second leg 26 of such L-shaped member 30, the nut-like member 38 and the cavity 46 formed adjacent the outer end surface 48 of such nut-like member 38 will be formed as an integral single piece unit. It is understood that this can be accomplished either by casting or machining. Nevertheless, it is within the scope of the present invention to weld such nut-like member 38 carrying the cavity 46 therein to such second leg 26 of the L-shaped member 30. It is also within the scope of the present invention to form such L-shaped member 30 by welding the first leg 14 thereof to the second leg 26.

Further, in the presently preferred embodiment of the invention, the bore 36, formed in the shaft member 18, adjacent the outer end surface 32 thereof, is threaded and such securing means 40 is a bolt 50 threadedly engaged in such bore 36. In this case, the aperture 34 formed through the second leg 26 of such L-shaped member 30 will be generally round and have a diameter that is slightly larger than the diameter of such bolt 50. Also, in this case, the cavity 46 formed in the nut-like member 38 will extend from the outer end surface 48 thereof to the back surface 42. Consequently, the head of the bolt 50 will be tightened against the outer surface 44 of such second leg 26.

As best seen in FIG. 1, at least a portion of the inner surface 28 and the outer surface 44 of such second leg 26 of the L-shaped member 30 will have a predetermined configuration. Such configuration will preferably be either generally circular or hexagonal. If the L-shaped member 30 and the nut-like member 38 are machined as a single piece, then such configuration could be hexagonal.

In operation, when it is necessary to rotate such bearing assembly 20, the apparatus 10 is engaged with the shaft member 18 and secured thereto by bolt 50. A tool, such as a wrench, is then engaged with the nut-like member 38 and the bearing assembly is rotated.

Figure 4:
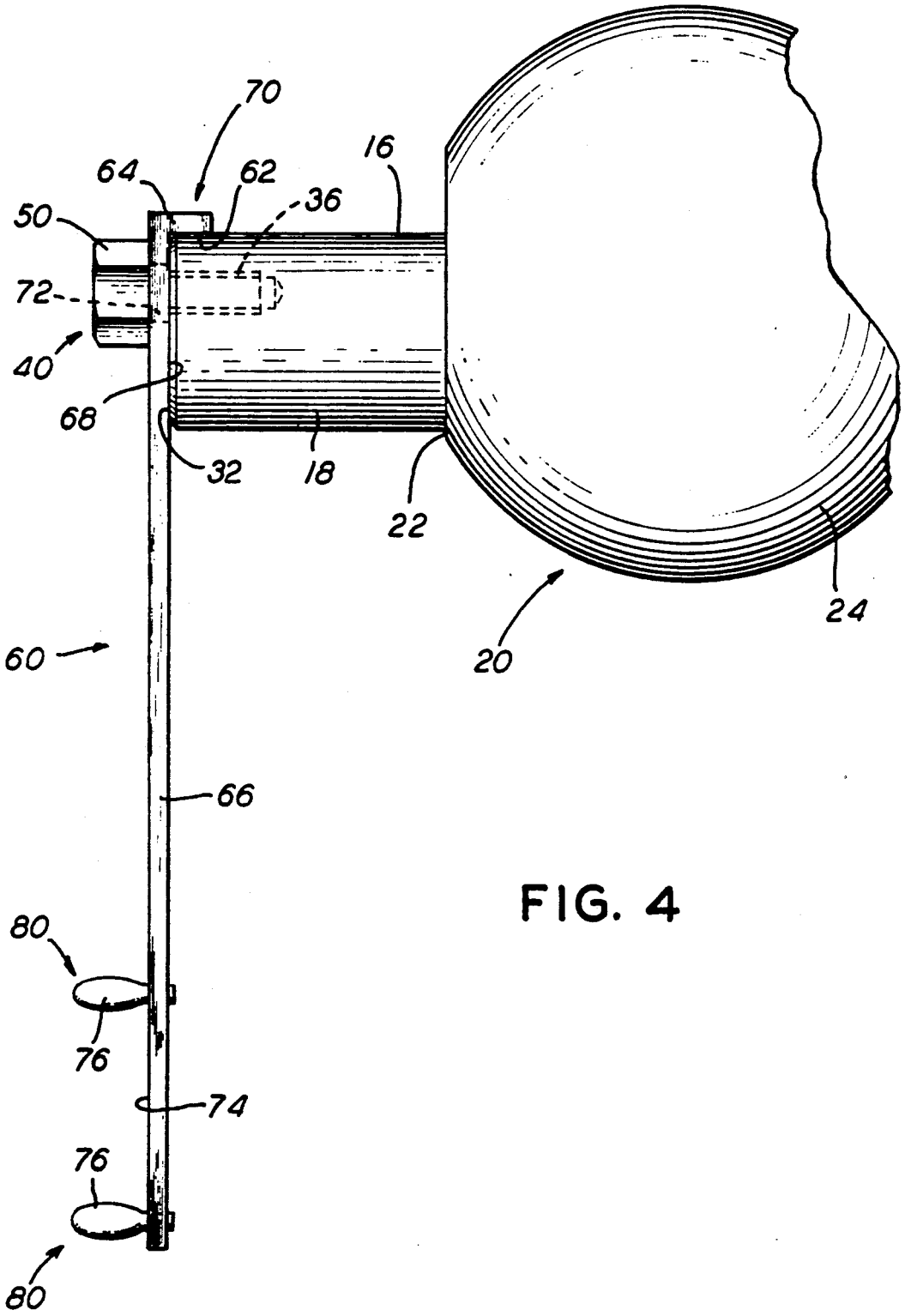
FIG. 4 is a fragmented side elevation view of an alternative embodiment of an apparatus for rotating a bearing assembly in an articulated coupling arrangement.

Now, refer more particularly to FIG. 4, wherein there is illustrated an alternative embodiment of an apparatus, generally designated 60, engageable with the bearing assembly 20. Such apparatus 60 includes a generally L-shaped member, generally designated 70, in which an inner surface 62 of a first leg 64 of such L-shaped member 70 is engageable with at least a portion of the substantially flat surface area 16 formed along a longitudinal axis of the shaft member 18, which is connected at one end thereof to the outer surface 22 of the spherical member 24 of such bearing assembly 20. A second leg 66 of the L-shaped member 70 is engageable at an inner surface 68 thereof with at least a portion of an axially opposed outer end surface 32 of such shaft member 18.

An aperture 72 is formed through a portion of such second leg 66 of the L-shaped member 70. Such aperture 72 is located in such second leg 66 so that during use of the apparatus 60 to rotate the bearing assembly 20, it will be disposed substantially within axial alignment with a substantially horizontally disposed and centrally located bore 36 formed in such shaft member 18 adjacent such outer end surface 3 thereof.

Apparatus 60 includes a securing means 40, preferably a bolt 50, positioned through such aperture 72 and disposed within such bore 36 which removably secures such apparatus 60 to the shaft member 18 of the bearing assembly 20. Also included in this embodiment of the apparatus 60 is at least one force application means, generally designated 80, which is secured to an outer surface 74 of such second leg 66 adjacent one end thereof. Such force application means 80, which is preferably a handle 76, enables application of a force at least sufficient to rotate such bearing assembly 20 to a position which will facilitate connection of such male connection member to such female connection member of the articulated coupling arrangement.

While a number of presently preferred embodiments and alternatives thereto of an apparatus for rotating a spherical member during assembly and disassembly of an articulated coupling apparatus have been described in detail above, it should be understood that persons who are skilled in the railway coupling art can make various modifications and adaptations of the present invention without departing from the spirit and scope of the appended claims.

We claim:

1. An apparatus engageable with a bearing assembly positioned in and secured to an aperture formed through an outer end portion of a male connection member of an articulated coupling arrangement for rotating such bearing assembly to a position which enables a substantially semi-permanent connection of such male connection member within a cavity formed in an outer end portion of a female connection member of such articulated coupling arrangement to be achieved, said apparatus comprising:

(a) a generally L-shaped member in which an inner surface of a first leg thereof is engageable with at least a portion of a substantially flat surface area formed along a longitudinal portion of a substantially round shaft member connected at one end thereof to an outer surface of a substantially spherical member of such bearing assembly and an inner surface of a second leg of said L-shaped member is engageable with at least a portion of an axially opposed outer end surface of such shaft member;

(b) an aperture formed through a portion of said second leg of said L-shaped member in a position such that during use of said apparatus to rotate such bearing assembly said aperture will be substantially in axial alignment with a substantially centrally located bore formed in such shaft member adjacent such outer end surface;

(c) a nut-like member having at least a portion of a back surface thereof engageable with and secured to at least a portion of an outer surface of said second leg of said L-shaped member, said nut-like member having a predetermined configuration which enables a tool, capable of applying a force thereto for rotating such bearing assembly to be engageable therewith;

(d) a cavity formed in said nut-like member adjacent an outer end surface thereof and substantially in axial alignment with said aperture formed through said second leg of said L-shaped member, said back surface of said nut-like member being axially opposed to said outer end surface of said nut-like member; and (e) a securing means positioned through said aperture formed through said second leg of said L-shaped member and disposed within both such bore formed in such shaft member and said cavity formed in said nut-like member for removable securing said apparatus to such shaft member so that such bearing assembly can be rotated as necessary to facilitate connection of such male connection member to such female connection member of such articulated coupling arrangement.

2. An apparatus, according to claim 1, wherein said first leg and said second leg of said L-shaped member are formed as an integral single piece unit.

3. An apparatus, according to claim 2, wherein said first leg and said second leg of said L-shaped member are cast as said integral single piece unit.

4. An apparatus, according to claim 3, wherein said aperture formed through said second leg of said L-shaped member is cast therein during casting of said integral single piece unit.

5. An apparatus, according to claim 2, wherein said first leg and said second leg of said L-shaped member are machined as said integral single piece unit.

6. An apparatus, according to claim 2, wherein said L-shaped member and said aperture formed through said second leg thereof and said nut-like member and cavity formed adjacent said outer end surface of said nut-like member are all formed as said integral single piece unit.

7. An apparatus, according to claim 6, wherein said L-shaped member and said aperture formed through said second leg thereof and said nut-like member and said cavity formed adjacent said outer end surface of said nut-like member are machined into said integral single piece unit.

8. An apparatus, according to claim 6, wherein said L-shaped member and said aperture formed through said second leg thereof and said nut-like member and said cavity formed adjacent said outer end surface of said nut-like member are cast into said integral single piece unit.

9. An apparatus, according to claim 1, wherein said bore formed adjacent such outer end surface of such shaft member is threaded and said securing means is a bolt.

10. An apparatus, according to claim 9, wherein said aperture formed through said second leg of said L-shaped member is generally round and has a diameter slightly larger than a diameter of said bolt.

11. An apparatus, according to claim 1, wherein said predetermined configuration of said nut-like member is hexagonal.

12. An apparatus, according to claim 1, wherein at least a portion of said inner surface and said outer surface of said second leg of said L-shaped member have a predetermined configuration.

13. An apparatus, according to claim 12, wherein said predetermined configuration of said at least a portion of said inner surface and said outer surface of said second leg of said L-shaped is generally circular.

14. An apparatus, according to claim 12, wherein said predetermined configuration of said at least a portion of said inner surface and said outer surface of said second leg of said L-shaped is generally hexagonal.

15. An apparatus, according to claim 1, wherein said nut-like member is secured to said second leg of said L-shaped member by welding.

16. An apparatus, according to claim 1, wherein said cavity formed in said nut-like member extends from said outer surface thereof to said back surface thereof.

17. An apparatus engageable with a bearing assembly positioned in and secured to an aperture formed through an outer end portion of a male connection member of an articulated coupling arrangement for rotating such bearing assembly to a position which enables a substantially semi-permanent connection of such male connection member within a cavity formed in an outer end portion of a female connection member of such articulated coupling arrangement to be achieved, said apparatus comprising:

(a) a generally L-shaped member in which an inner surface of a first leg thereof is engageable with at least a portion of a substantially flat surface area formed along a longitudinal portion of a substantially round shaft member connected at one end thereof to an outer surface of a substantially spherical member of such bearing assembly and an inner surface of a second leg of said L-shaped member is engageable with at least a portion of an axially opposed outer end surface of such shaft member;

(b) an aperture formed through a portion of said second leg of said L-shaped member in a position such that during use of said apparatus to rotate such bearing assembly said aperture will be substantially in axial alignment with a substantially centrally located bore formed in such shaft member adjacent such outer end surface;

(c) a securing means positioned through said aperture formed through said second leg of said L-shaped member and disposed within such bore formed in such shaft member for removably securing said apparatus to such shaft member; and (d) at least one force application means secured to an outer surface of said second leg of said L-shaped member adjacent one end thereof for applying a force sufficient to rotate such bearing assembly to a position which will facilitate connection of such male connection member to such female connection member of such articulated coupling arrangement.

18. An apparatus, according to claim 16, wherein said first leg and said second leg of said L-shaped member are formed as an integral single piece unit.

19. An apparatus, according to claim 17, wherein said bore formed adjacent such outer end surface of such shaft member is threaded and said securing means is a bolt.

20. An apparatus, according to claim 18, wherein said aperture formed through said second leg of said L-shaped member is generally round and has a diameter slightly larger than a diameter of said bolt.

21. An apparatus, according to claim 19, wherein said force application means is a handle.

* * * * *

UNITED STATES PATENT AND TRADEMARK OFFICE

CERTIFICATE OF CORRECTION

PATENT NO. : 5,092,204

DATED : March 3, 1992

INVENTOR(S) : Mike Labriola

It is certified that error appears in the above-identified patent and that said Letters Patent is hereby corrected as shown below:

Column 2, line 31, delete "o", and insert --on--.

Column 7, line 2, delete "3", and insert --34--.

Column 7, line 62, delete "3", and insert --32--.

In the abstract, line 4, delete "first", and insert --flat--.

In the abstract, line 13, delete "apparaus", and insert --apparatus--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*